United States Patent [19]

Tanahashi et al.

[11] Patent Number: 4,938,213

[45] Date of Patent: Jul. 3, 1990

[54] TWO-STROKE ENGINE

[75] Inventors: Toshio Tanahashi; Toshio Itoh; Masanobu Kanamaru; Kazuhiro Itoh, all of Susono, Japan

[73] Assignee: Toyota Jidosha Kabushiki Kaisha, Aichi, Japan

[21] Appl. No.: 342,169

[22] Filed: Apr. 20, 1989

[30] Foreign Application Priority Data

Apr. 26, 1988 [JP] Japan ..... 63-101322

[51] Int. Cl.[5] ..... F02B 31/00

[52] U.S. Cl. ..... 123/301; 123/73 C; 123/308; 123/193 H

[58] Field of Search ..... 123/301, 306, 193 CH, 123/193 H, 432, 308, 73 C

[56] References Cited

U.S. PATENT DOCUMENTS

| | | | |
|---|---|---|---|
| 2,741,230 | 4/1956 | Reynolds | 123/301 |
| 2,768.615 | 10/1956 | Taylor et al. | 123/301 |
| 2,832,324 | 4/1958 | Barber | 123/301 |
| 2,840,062 | 6/1958 | Classen | 123/301 |
| 3,572,298 | 3/1971 | Onishi et al. | 123/301 |
| 3,924,598 | 12/1975 | Davis | 123/306 |
| 4,162,662 | 7/1979 | Melchior | 123/65 VD |
| 4,790,270 | 12/1988 | McKay et al. | 123/73 C |
| 4,840,147 | 6/1989 | Tanahashi et al. | 123/65 VD |

FOREIGN PATENT DOCUMENTS

| | | | |
|---|---|---|---|
| 45-15762 | 6/1970 | Japan . | |
| 50-128017 | 4/1977 | Japan . | |
| 0060316 | 5/1977 | Japan | 123/73 C |
| 62-95131 | 6/1987 | Japan . | |
| 0314312 | 12/1988 | Japan | 123/306 |

*Primary Examiner*—David A. Okonsky
*Attorney, Agent, or Firm*—Oliff & Berridge

[57] ABSTRACT

A two-stroke engine having an intake valve and an exhaust valve which are arranged on the cylinder head. A masking wall is formed on the inner wall of the cylinder head to mask the valve opening between the valve seat and the peripheral portion of the intake valve, which is located on the exhaust valve side, for the entire time for which the intake valve is open. Due to the masking wall, fresh air fed into the cylinder is turned around a central axis perpendicular to the axis of the cylinder. A fuel injector is arranged on the inner wall of the cylinder on the central axis to inject fuel therefrom along the central axis.

16 Claims, 4 Drawing Sheets

TWO-STROKE ENGINE

BACKGROUND OF THE INVENTION

1. Field of the Invention

The present invention relates to a two-stroke engine.

2. Description of the Related Art

In a Schnürle type two-stroke engine having no intake valve and no exhaust valve, a two-stroke engine is known in which a fuel injector is arranged on the inner wall of the cylinder and fuel is injected from the fuel injector in such a manner that it moves forward along the stream of the scavenging flow of fresh air, which is forced into the shape of a loop (see Japanese Examined Patent Publication No. 45-157621. In this two-stroke engine, fuel injected from the fuel injector is made to move together with the scavenging flow and is carried thereby up to the spark plug so that the air-fuel mixture is easily ignited by the spark plug.

Where the injected fuel is made to move together with the scavenging flow, however, the injected fuel collects in the vicinity of the inner walls of the cylinder and the cylinder head, due to centrifugal force, and as a result, since a homogeneous air-fuel mixture is not formed in the combustion chamber, a problem occurs in that a good combustion cannot be obtained, particularly when the engine is operating under a heavy load. Further, where the injected fuel is made to move together with the scavenging flow, a part of the injected fuel adheres to the inner walls of the cylinder and the cylinder head, and thus another problem occurs in that a large amount of unburned HC is produced and discharged.

SUMMARY OF THE INVENTION

An object of the present invention is to provide a two-stroke engine capable of obtaining a good combustion, particularly when the engine is operating under a heavy load, and capable of reducing the amount of unburned HC discharged from the engine cylinder.

According to the present invention, there is provided a two-stroke engine comprising: a cylinder having an inner wall; a fresh air feeding means for feeding fresh air into the cylinder; a combustion gas discharging means for discharging combustion gas from the cylinder; a fresh air turning means for turning the fresh air around a central axis perpendicular to an axis of the cylinder; and an injection means for injecting fuel into the cylinder along the central axis.

The present invention may be more fully understood from the description of preferred embodiments of the invention set forth below, together with the accompanying drawings.

DESCRIPTION OF THE PREFERRED EMBODIMENTS

Figure 1:
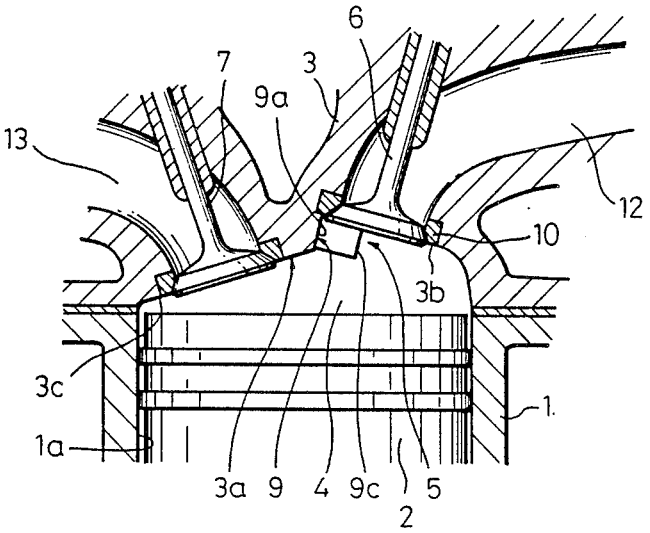
FIG. 1 is a cross-sectional side view of a two-stroke engine.
Figure 2:
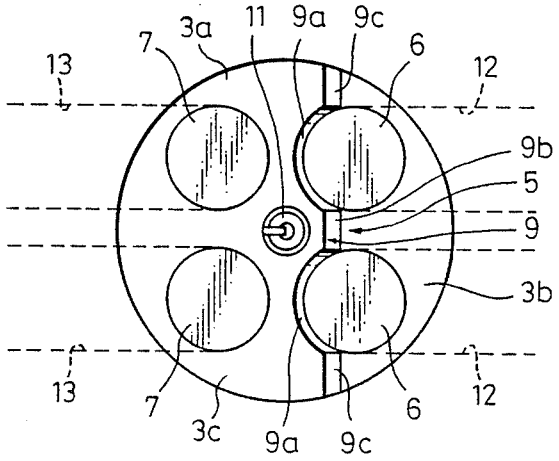
FIG. 2 is a view illustrating the inner wall of the cylinder head.

Referring to FIGS. 1 and 2, reference numeral 1 designates a cylinder block, 2 a piston reciprocally movable in the cylinder block 1, 3 a cylinder head fixed onto the cylinder block 1, and 4 a combustion chamber formed between the inner wall 3*a* of the cylinder head 3 and the top face of the piston 2. A depression 5 is formed on the inner wall 3*a* of the cylinder head 3, and the intake valves 6 are arranged on the inner wall portion 3*b* of the cylinder head 3, which forms the bottom wall of the depression 5. The inner wall portion 3*c* of the cylinder head 3 other than the depression 5 is substantially flat, and the exhaust valves 7 are arranged on this inner wall portion 3*c* of the cylinder head 3. The inner wall portions 3*b* and 3*c* of the cylinder head 3 are interconnected via the peripheral wall 9 of the depression 5. The peripheral wall 9 of the depression 5 comprises masking walls 9*a* arranged as close as possible to the peripheral portions of the corresponding intake valves 6 and extending archwise along the periphery of the corresponding intake valves 6, a fresh air guide wall 9*b* arranged between the intake valves 6, and fresh air guide walls 9*c* each arranged between the circumferential wall of the inner wall 3*a* of the cylinder head 3 and the corresponding intake valve 6. The masking walls 9*a* extend toward the combustion chamber 4 to a position lower than the intake valves 6 when the valves 6 are in the maximum lift position, and thus the valve opening between the valve seat 10 and the peripheral portion of the intake valve 6, which is located on the exhaust valve side, is masked by the corresponding masking wall 9*a* for the entire time for which the intake valve 6 is open. The fresh air guide wall 9*b* and the fresh air guide walls 9*c* are located on substantially the same plane and extend substantially in parallel to the line passing through the centers of the intake valves 6. The spark plug 11 is arranged on the inner wall portion 3*c* of the cylinder head 3 in such a manner that it is located at the center of the inner wall 3*a* of the cylinder head 3.

Intake ports 12 are formed in the cylinder head 3 for the intake valves 6, and exhaust ports 13 are formed in the cylinder head 3 for the exhaust valves 7. The intake ports 12 are connected to the air cleaner (not shown) via, for example, a mechanically driven supercharger driven by the engine and via a throttle valve.

Figure 3:
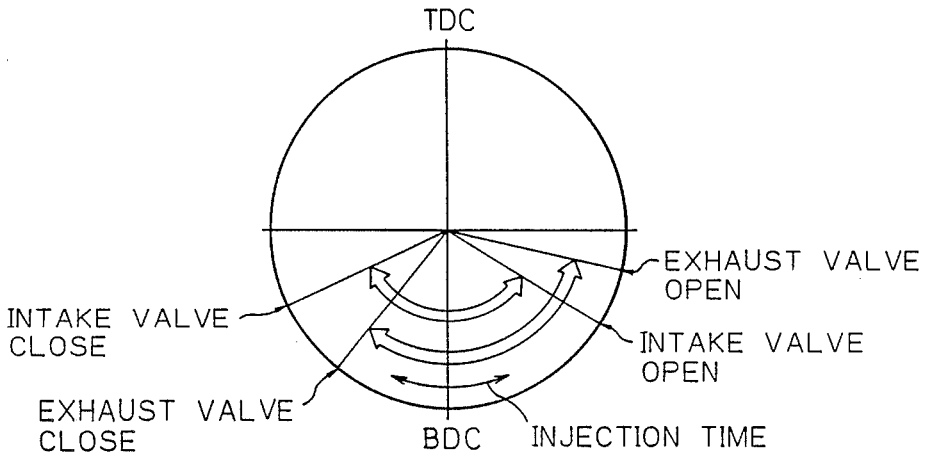
FIG. 3 is a diagram illustrating the opening time of the intake valve and the exhaust valve.

FIG. 3 illustrates an example of the opening time of the intake valves 6 and the exhaust valves 7. In the example illustrated in FIG. 3, the exhaust valves 7 open earlier than the intake valves 6, and the exhaust valves 7 close earlier than the intake valves 6.

When the piston 2 moves downward, and the exhaust valves 7 open, combustion gas under a high pressure in the combustion chamber 4 flows out into the exhaust port 13.

Subsequently, when the intake valves 6 open, fresh air is fed into the combustion chamber 4 from the intake ports 12. At this time, since the masking walls 9*a* are provided for the valve openings of the intake valves 6, the fresh air flows mainly into the combustion chamber 4 from portions of the valve openings of the intake valves 6, which portions are located on the opposite side with respect to the masking walls 9*a*. Then, as illustrated by the arrow S in FIG. 4, the flow direction of the fresh air is changed on the top face of the piston 2, and the fresh air moves toward the exhaust valves 7. As a result, the combustion gas in the combustion chamber 4 is pushed out by the fresh air and discharged into the exhaust ports 13, and thus a loop scavenging operation is realized in the combustion chamber 4.

In the embodiment illustrated in FIGS. 1 and 2, the arced masking walls 9a have a relatively long length, and at the valve opening between the intake valve 6 and the valve seat 10, one-third of the valve opening, which is located on the exhaust valve side, is masked by the corresponding masking wall 9a, and the fresh air is fed from the unmasked two-thirds of the valve opening, which is located at the opposite side of the exhaust valve 7. In addition, in this embodiment, the fresh air flowing into the combustion chamber 4 from the intake valve 6 is guided by the fresh air guide walls 9b, 9c so as to flow downward along the inner wall of the cylinder 1a. Consequently, in this embodiment, when the intake valves 6 open, a large part of the fresh air flows toward the top face of the piston 2 along the inner wall of the cylinder 1a, and thus a good loop scavenging operation is carried out.

Figure 4:
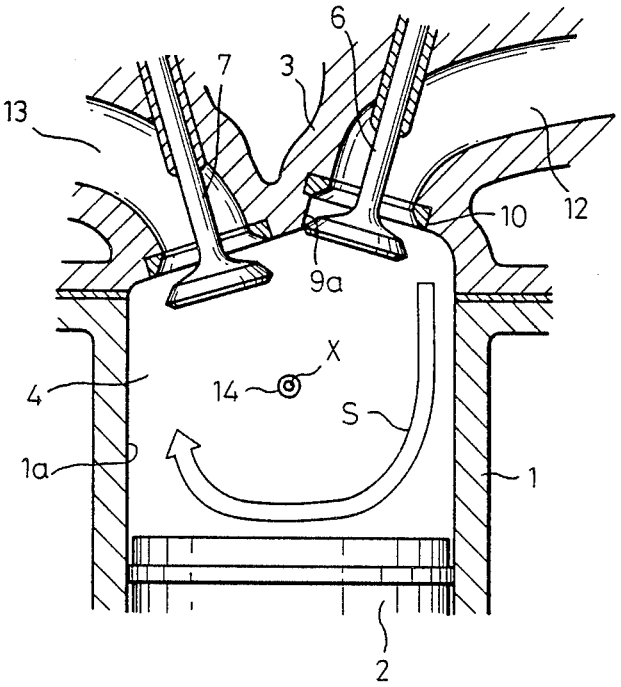
FIG. 4 is a cross-sectional side view of the engine, illustrating the operation of the engine.

As illustrated in FIG. 4, the scavenging flow S flowing in the form of a loop is turned around a central axis X perpendicular to the axis of the cylinder 1a. In the embodiment illustrated in FIG. 4, a fuel injector 14 is arranged on the inner wall of the cylinder la on the central axis X, and fuel is infected from the fuel injector 14 toward the central portion of the combustion chamber 4 along the central axis X when the piston 2 is approximately at the bottom dead center, as illustrated in FIG. 3. Consequently, the fuel injected from the fuel injector 14 is surrounded by the scavenging flow S, and the fuel thus injected is pulled by the scavenging flow S, and is turned together with the scavenging flow S. At this time, the vaporized fuel and fuel droplets having a relatively small size are collected around the central axis X, and fuel droplets having a relatively large size are moved away from the central axis X due to the centrifugal force, and thus, since a homogeneous air-fuel mixture is formed in the combustion chamber 4, a good combustion can be obtained. In addition, at this time, the fuel droplets do not reach the inner wall of the cylinder la, the inner wall 3a of the cylinder head 3 and the top face of the piston 2, and thus the fuel droplets are surrounded by the fresh air layer which is turned by the scavenging flow S. Consequently, fuel will not adhere to the inner wall of the cylinder 1a, the inner wall 3a of the cylinder head 3 and the top face of the piston 2, and the generation of unburned HC can be suppressed.

Figure 5:
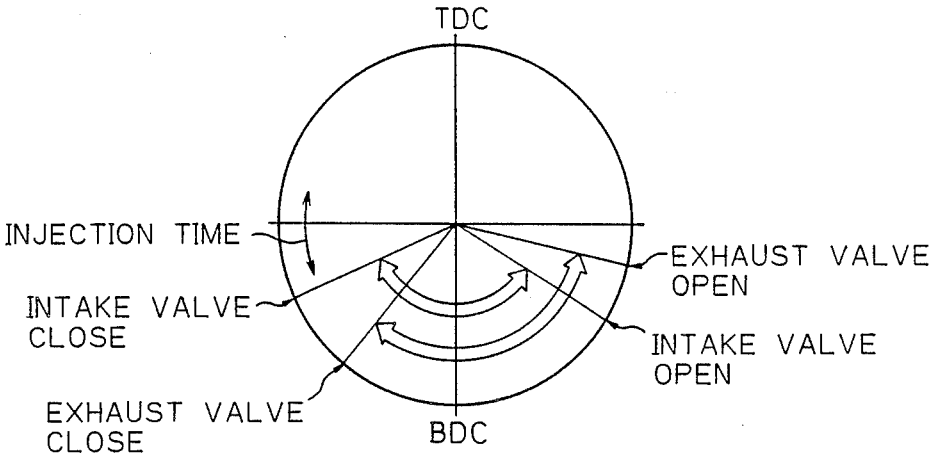
FIG. 5 is a diagram illustrating the opening of the intake valve and the exhaust valve.
Figure 6:
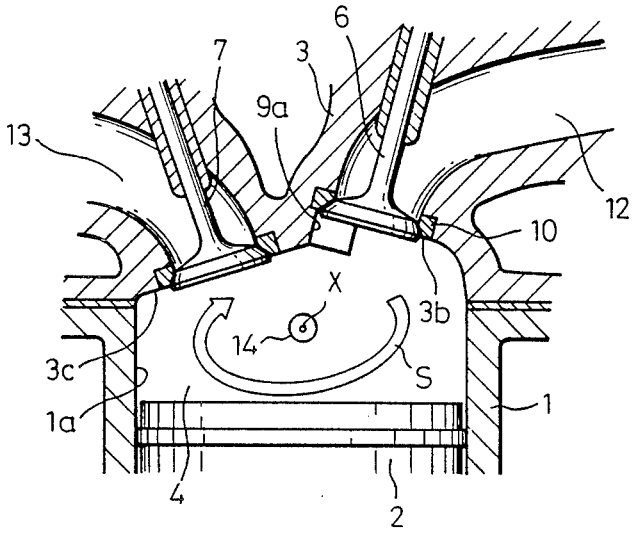
FIG. 6 is a cross-sectional side view of an alternative embodiment of a two-stroke engine.

FIGS. 5 and 6 illustrate an alternative embodiment. In this embodiment, as illustrated in FIG. 5, fuel is injected from the fuel injector 14 after both the intake valves 6 and the exhaust valves 7 are closed. Consequently, in this embodiment, it is possible to completely prevent a discharge of the injected fuel into the exhaust ports 13. Also in this embodiment, the fuel injector 14 is arranged on the inner wall of the cylinder 1a on the central axis X around which the scavenging flow S is turned, and fuel is infected from the fuel injector 14 along the central axis X.

According to the present invention, since a homogeneous air-fuel mixture is formed in the combustion chamber, particularly when the engine is operating under a heavy load, a good combustion can be obtained. In addition, since the fuel will not adhere to the inner wall of the cylinder etc., the amount of unburned HC discharged from the cylinder can be reduced.

While the invention has been described by reference to specific embodiments chosen for purposes of illustration, it should be apparent that numerous modifications could be made thereto by those skilled in the art without departing from the basic concept and scope of the invention.

We claim:

1. A two-stroke engine comprising:
a cylinder having an inner wall;
fresh air feeding means for feeding fresh air into said cylinder;
combustion gas discharging means for discharging combustion gas from said cylinder;
fresh air turning means for turning said fresh air around a central axis perpendicular to an axis of said cylinder; and
injection means for injecting fuel into said cylinder along said central axis.

2. A two-stroke engine according to claim 1, wherein said injection means is arranged on the inner wall of said cylinder on said central axis.

3. A two-stroke engine according to claim 1, wherein said central axis is a central axis around which said fresh air is turned when the fuel is injected from said injection means.

4. A two-stroke engine according to claim 3, wherein the fuel is injected from said injection means when the fresh air is fed into said cylinder and when the combustion gas is discharged from said cylinder.

5. A two-stroke engine according to claim 3, wherein the fuel is injected from said injection means after the operation of feeding the fresh air is stopped and after the operation of discharging the combustion gas is stopped.

6. A two-stroke engine according to claim 1, further comprising a piston reciprocally movable in said cylinder, and a cylinder head having an inner wall, wherein said fresh air feeding means comprises at least one intake valve arranged on the inner wall of said cylinder head, and said combustion gas exhausting means comprises at least one exhaust valve arranged on the inner wall of said cylinder head, said fresh air turning means preventing the fresh air from being fed into said cylinder from a valve opening of said intake valve, which is located on said exhaust valve side.

7. A two-stroke engine according to claim 6, wherein said fresh air turning means comprises a masking device arranged between said intake valve and said exhaust valve to mask a valve opening formed between a valve seat and a peripheral portion of said intake valve, which is located on said exhaust valve side, for the entire time for which said intake valve is open.

8. A two-stroke engine according to claim 7, wherein said masking device has a masking wall arranged close to a peripheral portion of said intake valve, which is located on said exhaust valve side, and extending downward toward said piston to a position lower than said intake valve when said intake valve is in the maximum lift position thereof.

9. A two-stroke engine according to claim 8, wherein said masking wall extends in an arc along the peripheral portion of said intake valve.

10. A two-stroke engine according to claim 9, wherein said masking wall extends along approximately one-third of the peripheral portion of said intake valve.

11. A two-stroke engine according to claim 8, wherein said inner wall of said cylinder head has a depression formed thereon and comprises a substantially flat inner wall portion other than said depression, a bottom wall of said depression, and a circumferential wall of said depression, which is located between said inner wall portion and said bottom wall, said intake valve being arranged on said bottom wall, said exhaust valve being arranged on said inner wall portion, and said masking wall being formed on said circumferential wall.

12. A two-stroke engine according to claim 11, wherein the circumferential wall of said depression extends between opposed ends of a circumferential wall of the inner wall of said cylinder head, and a portion of said circumferential wall other than said masking wall forms a fresh air guide wall extending downward toward said piston.

13. A two-stroke engine according to claim 12, wherein said engine is provided with two intake valves and said fresh air guide wall comprises a first guide wall located between said intake valves and second guide walls located between the circumferential wall of the inner wall of said cylinder head and said intake valves.

14. A two-stroke engine according to claim 13, wherein said first guide wall and said second guide walls are located in substantially a same plane which extends substantially in parallel to a line passing through said intake valves.

15. A two-stroke engine according to claim 11, further comprising a spark plug arranged on said inner wall portion approximately at a center of the inner wall of said cylinder head.

16. A two-stroke engine according to claim 6, wherein said exhaust valve opens earlier than said intake valve and closes earlier than said intake valve.

* * * * *